US005951414A

United States Patent [19]

Sowards

[11] Patent Number: 5,951,414

[45] Date of Patent: Sep. 14, 1999

[54] SOCCER TRAINING DEVICE

[76] Inventor: Gregory E. Sowards, 2916 Maese Land, Las Cruces, N.Mex. 88005

[21] Appl. No.: 09/112,475

[22] Filed: Jul. 9, 1998

[51] Int. Cl.[6] ..... A63B 69/00

[52] U.S. Cl. ..... 473/423

[58] Field of Search ..... 473/420, 423, 473/424, 425, 426, 427, 428, 429, 430

[56] References Cited

U.S. PATENT DOCUMENTS 4,307,888 12/1981 Ohle ..... 473/429
4,477,083 10/1984 Sowards ..... 473/423
4,720,095 1/1988 Sowards ..... 473/423
5,037,113 8/1991 Sowards ..... 473/423
5,620,186 4/1997 Dudley ..... 473/423

*Primary Examiner*—William H. Grieb
*Attorney, Agent, or Firm*—Hoffman, Wasson & Gitler

[57] ABSTRACT

A sports training device has a base to hold the ball. Straps are attached to the base and secure the ball to the base. Mating fasteners allow the straps to join to one another and result in the easy set up and disassembly of the training device.

19 Claims, 9 Drawing Sheets

SOCCER TRAINING DEVICE

The present invention is a device for training soccer players' ball handling skills. The invention includes a base which rests on the ground and a coupling mechanism for attaching a conventional soccer ball to the base.

BACKGROUND OF THE INVENTION

Soccer training devices are well known in the art. Typically, the devices of the prior art provide a specially configured ball or comparable target which may be fixed relative to a playing surface. For example, U.S. Pat. No. 5,037,113, issued Aug. 6, 1991, to G. E. Sowards, describes a soccer training device including a pedestal connected to a specially-configured ball. Referring to FIG. 2, the ball 1 receives the stem 4 of a coil spring 3 which is connected to the pedestal 2. A nut 5 is received both on the inside of the ball and on the outside as shown. The ball is not able to be used in any other setting and, since it is specially-configured, significantly increases the cost of the device manufactured.

U.S. Pat. No. 4,720,095, issued Jan. 19, 1988, to G. E. Sowards, describes a sports training and practice device including a ground-engaging anchor connected to a specially-configured ball. Referring to FIG. 10, the device includes an anchor 112 which is threadingly received in a playing surface. A specially-configured ball 110 includes a tag 122 having a hole 124 which receives one end of a link 128. The other end of the link attaches to the anchor 112 at the loop 118. As with the '113 invention discussed above, this invention also requires a specially-configured ball which limits the usefulness of the ball itself and increases the manufacturing costs thereof. Referring to FIG. 1, the device provides for an embodiment wherein a bladder 48 is received in a tear-drop shaped cover 50. The cover 50 is attached to the anchor 24 via a spring 40. In addition to not truly being representative of a soccer ball, this bladder and cover configuration also is not adaptable to any other use and increases the manufacturing costs of the device.

In FIGS. 11–13 of the '095 patent, a ball held onto a cup by straps is disclosed. The straps are secured to the post that supports the cup. This arrangement allows the straps to work themselves around the post and create a space between the straps to allow the ball to be released from its confinement. The buckles used to connect two straps together make it difficult to maintain proper tension.

U.S. Pat. No. 4,477,083, issued Oct. 16, 1984, to G. E. Sowards, describes a sports training and practice device including a trampoline with an arm extending therefrom and a kicking target resiliently mounted thereto. Referring to FIG. 2, the bag 70 is described as being similar to a punching bag. The cover 74 retains a bladder 72 and a cone 76 in abutment. The top 68 of spring 62 is received in bore 78 of the cone 76.

The present invention overcomes the limitations of the above by providing a device which accepts and secures a conventional soccer ball. This innovation not only increases the utility of the kicking target used, a conventional soccer ball, but also reduces the cost associated with the device, therefore is more available to those who need it.

The prior art does show a mechanism for receiving and securing a conventional soccer ball. For example, in U.S. Pat. No. 4,720,095, specifically FIGS. 11–13, a screw-like anchor is resiliently mounted to a cup which includes two straps which bind the ball to the cup and have interengaging hook-and-loop fasteners to assure the positioning of the straps around the ball. Unfortunately, the device, in its entirety, does not lend well to use on artificial playing surfaces and is quite cumbersome to use.

The present device is readily usable on any type of playing surface and includes a fastening mechanism which is more reliable and easier to use than prior art devices.

BRIEF DESCRIPTION OF THE DRAWINGS

Similar reference characters denote corresponding features of the invention consistently throughout the attached drawings.

DETAILED DESCRIPTION OF THE INVENTION

Figure 1:
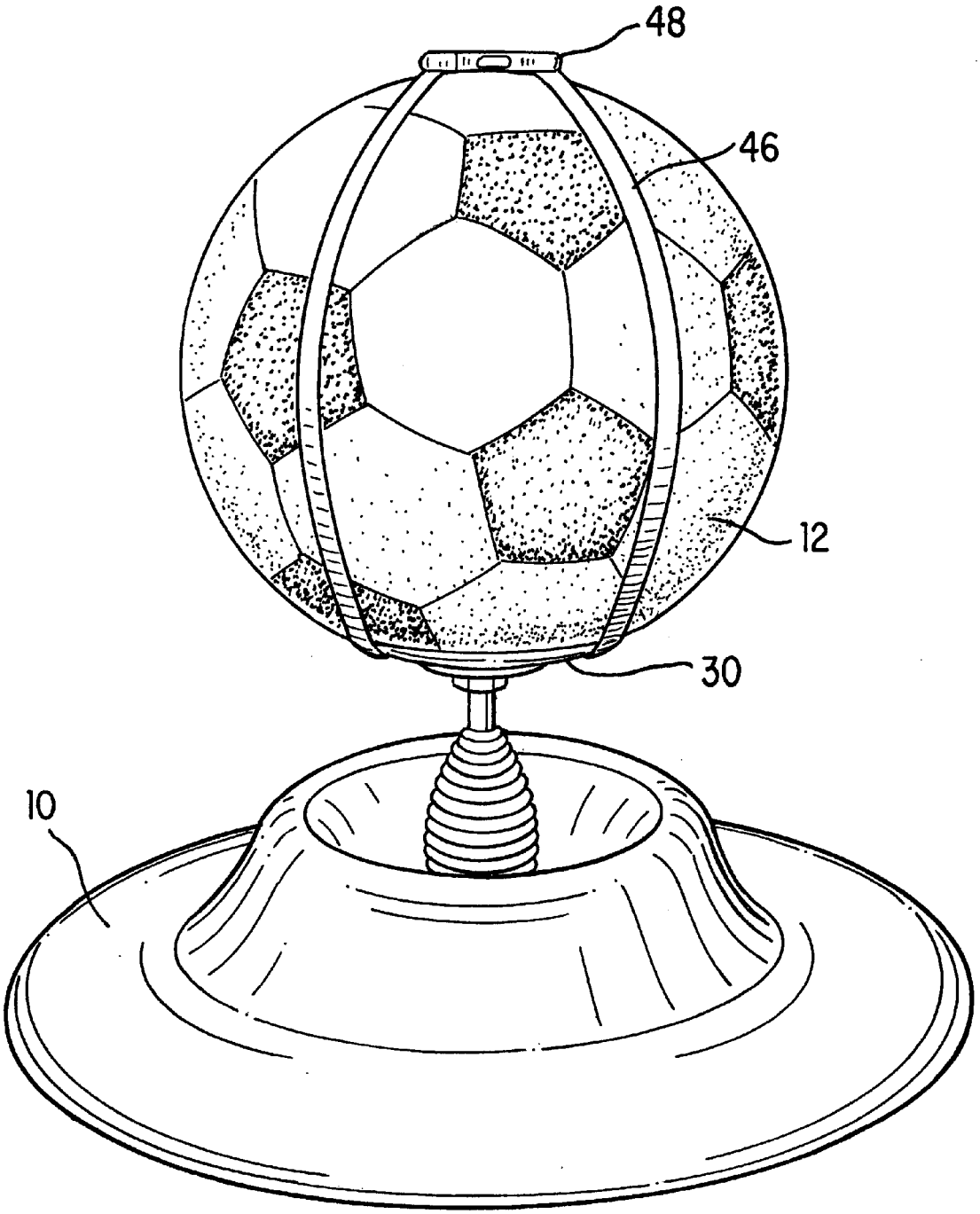
FIG. 1 is a top front perspective view of the invention.
Figure 2:
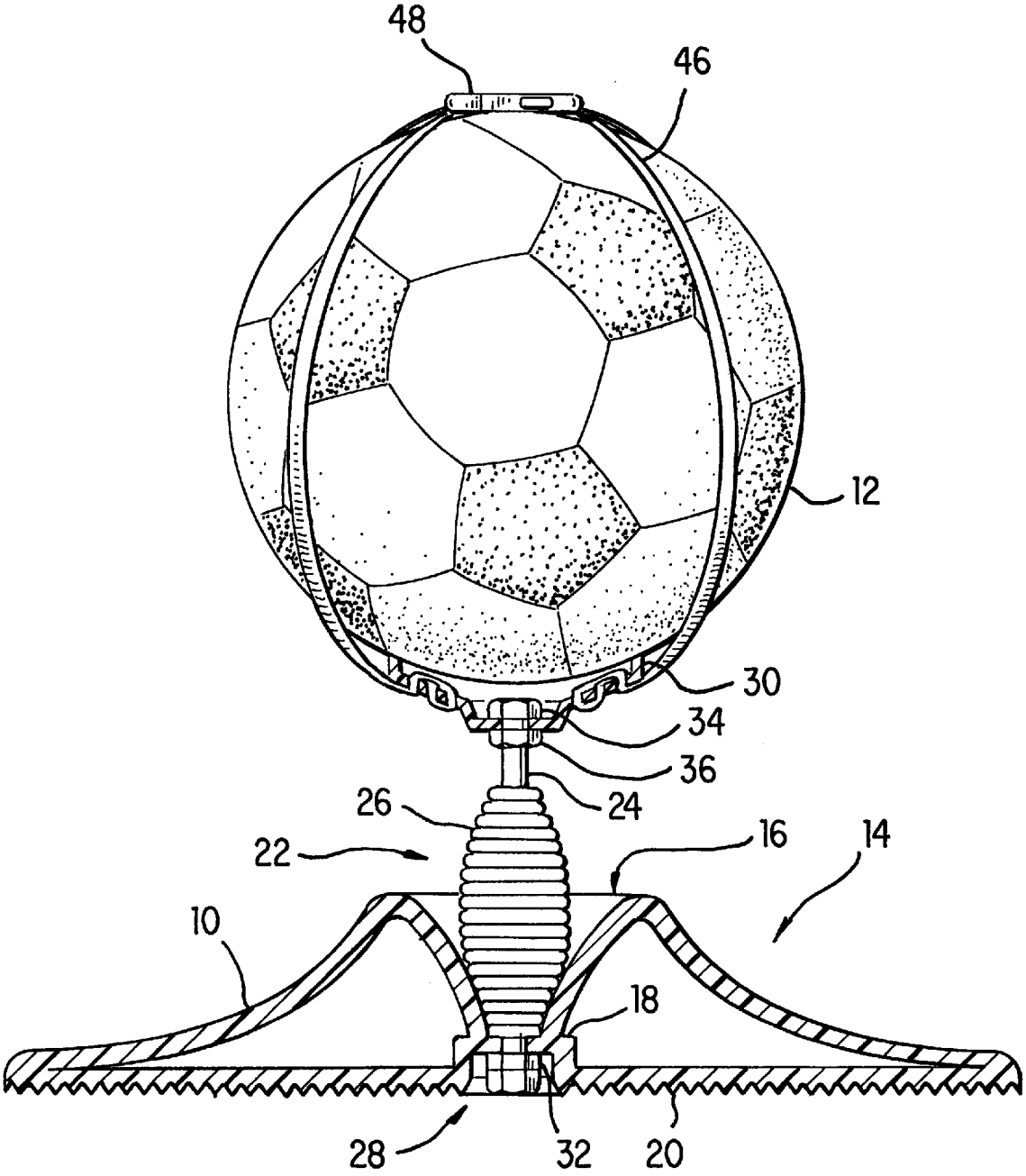
FIG. 2 is a partial cross-sectional detailed view thereof.

Referring to FIGS. 1 and 2, the device includes a base 10. The base is intended to provide structure and/or to have a sufficient moment of inertia such that when a user is training with the device, i.e. kicking the ball 12, the device remains substantially in place. The device is not intended to be limited to any particular type of base to accomplish this feature. Preferably, the base is made as a hollow body whose exterior defines a shape which does not interfere with the user such as when the user is kicking the ball. The hollow interior of the base may be filled with water or stones or sand or any like weighty filler.

Referring particularly to FIG. 2, the base 10 should be configured so as to avoid interference with the user's kicking motion. Ideally, the base 10 should conform to the playing surface. However, the base 10 must accommodate a coupling mechanism, discussed below, which secures the ball to the base 10. Nevertheless, the base 10 should assume the least obtrusive, yet structurally-viable shape. Accordingly, the upper, radially outward surface of the base 10 may assume a flat, convex or other shape, here indicated generally with the numeral 14, which accomplishes the objectives of the invention. The concave profile shown is for illustrative purposes only, and is not intended to limit the preferred embodiment of the present invention.

Inward of the outer shape 14, the base 10 has a recess 16. The shape of the recess 16 is not critical to the functioning of the invention, except that it should not interfere with the coupling mechanism, discussed below. Accordingly, the recess 16 should assume the least obtrusive, yet structurally-viable shape. As shown in vertical cross section, the recess 16 assumes the shape of an inverted conical section with sides. At the tip of the conic shape, near the bottom of the base, the base 10 provides a seat 18 which receives the coupling mechanism.

The base 10 also has a lower surface 20 which is intended to rest on a playing surface. Although the lower surface 20 is not restricted to any particular shape or texture, the base 10 tends to remain in place better when the lower surface 20 has a rough texture or other conventional mechanism to adhere or otherwise maintain objects with respect to a surface. Preferably, the lower surface 20 has a grooved or serrated surface that may better grip the playing surface on which the device is used.

A ball may be joined to the base with a coupling mechanism 22. The coupling mechanism 22 functions not only to retain the ball to the base 10, but to provide some elasticity as between the base 10 and ball 12. The base 10 is intended to be stationary and resistant to movement. If the ball were fixed rigidly to the base 10, a user may risk strained muscles and tendons from repeated interactions with such a resultantly non-resilient target. Accordingly, the present invention includes a coil spring 26 to add resiliency to the device. A threaded lower stem 28 and a threaded upper stem 24 extend from opposite ends of a coil spring 26. The lower stem 28 is received in the seat 18 of the base 10. A nut 32 threadingly engages the lower stem 28 and retains it to the base.

A critical advance of the present invention is the cup 30 that receives a conventional ball 12. A nut 34 and a nut 36 cooperate to retain the cup 30 onto the upper stem 24. Prior inventions have required the use of specially-configured balls that may only be used with the device, thus providing less utility at a higher cost. The present cup allows the user to employ any conventional soccer ball during training.

Figure 3:
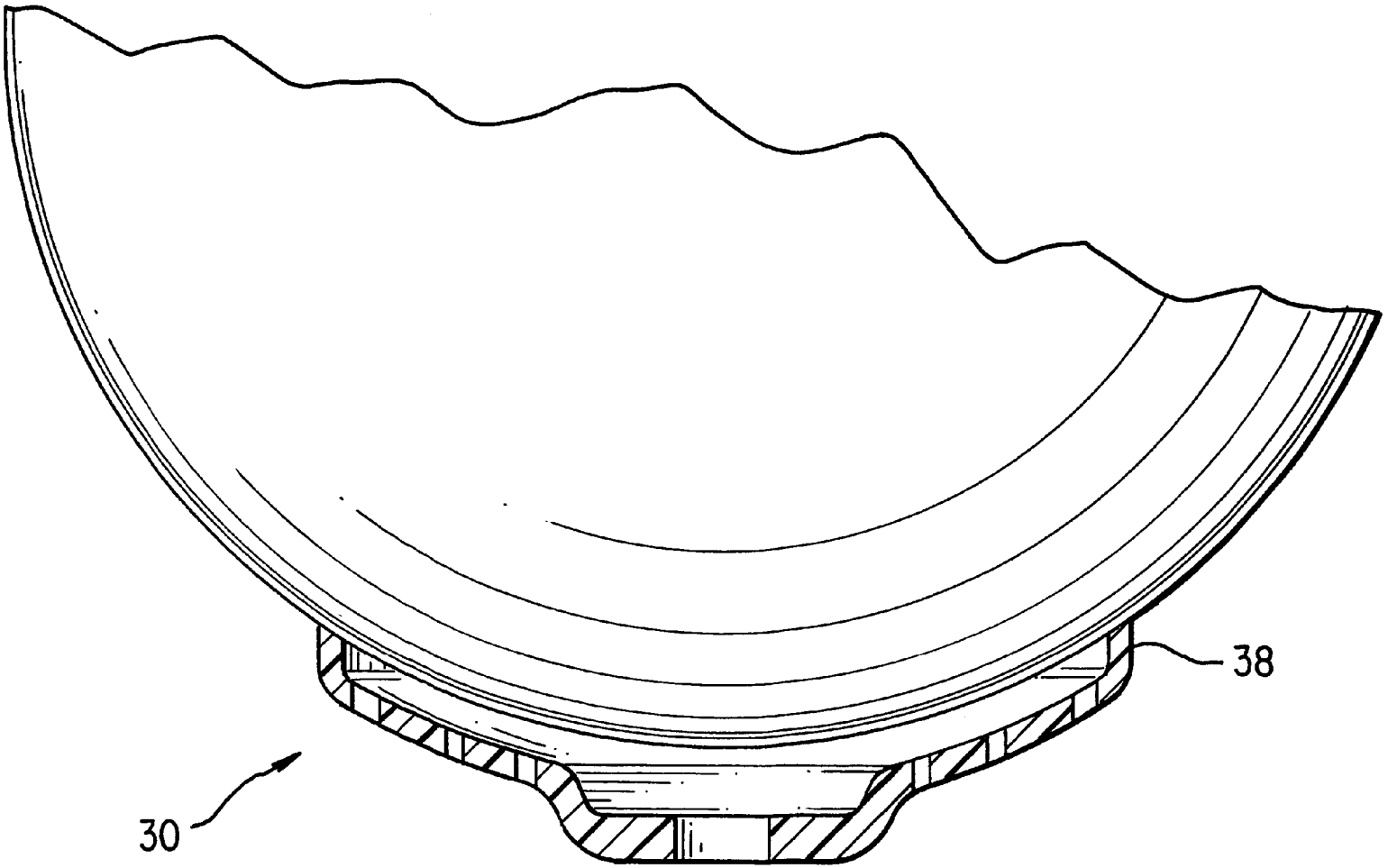
FIG. 3 is a cross-sectional detailed view of the cup of the present invention.
Figure 4:
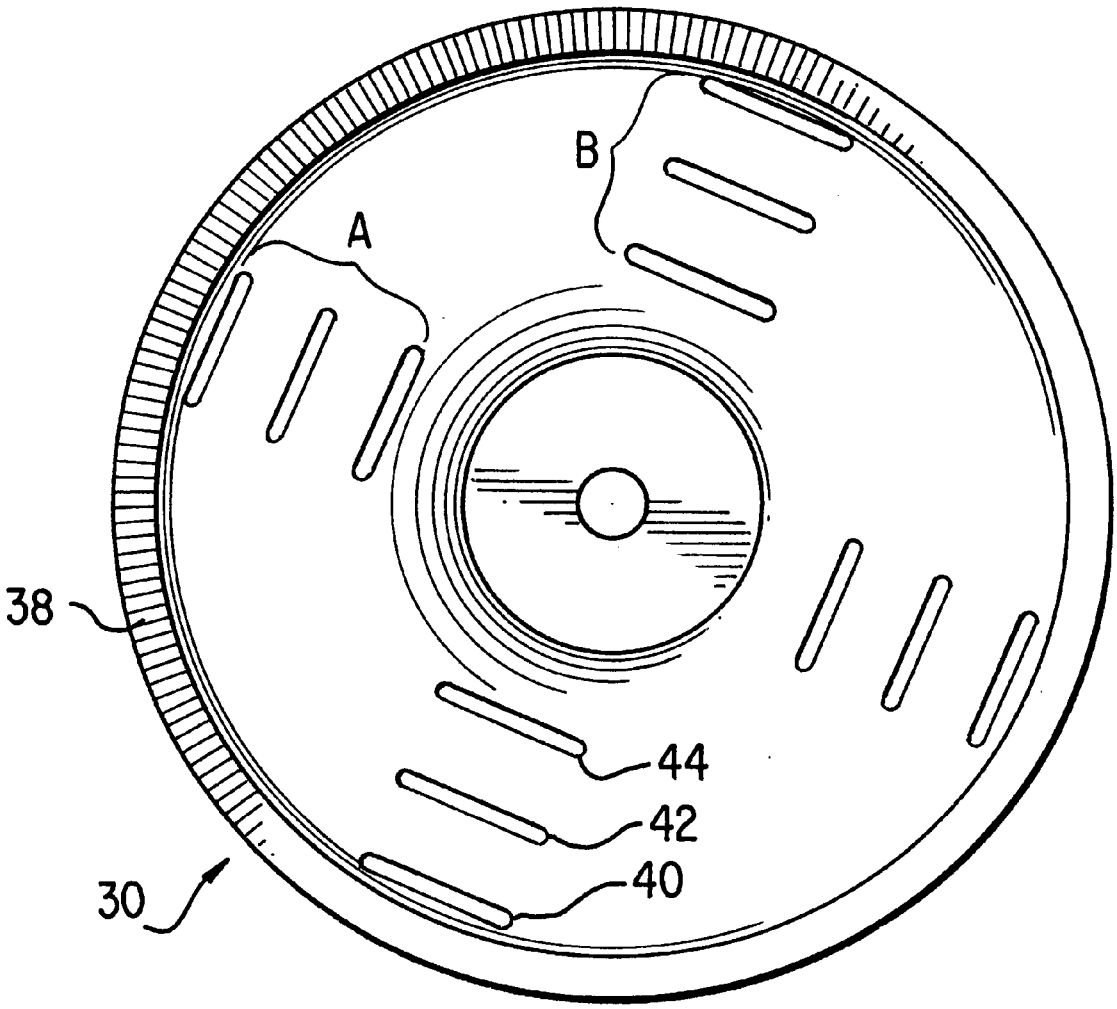
FIG. 4 is a top view of the base.

Referring to FIGS. 3 and 4, greater detail of the cup 30 is shown. The cup 30 has an annular lip 38 with a smooth surface for receiving a soccer ball. The lip 38 does not have any sharp surfaces that may puncture the ball.

Figure 9:
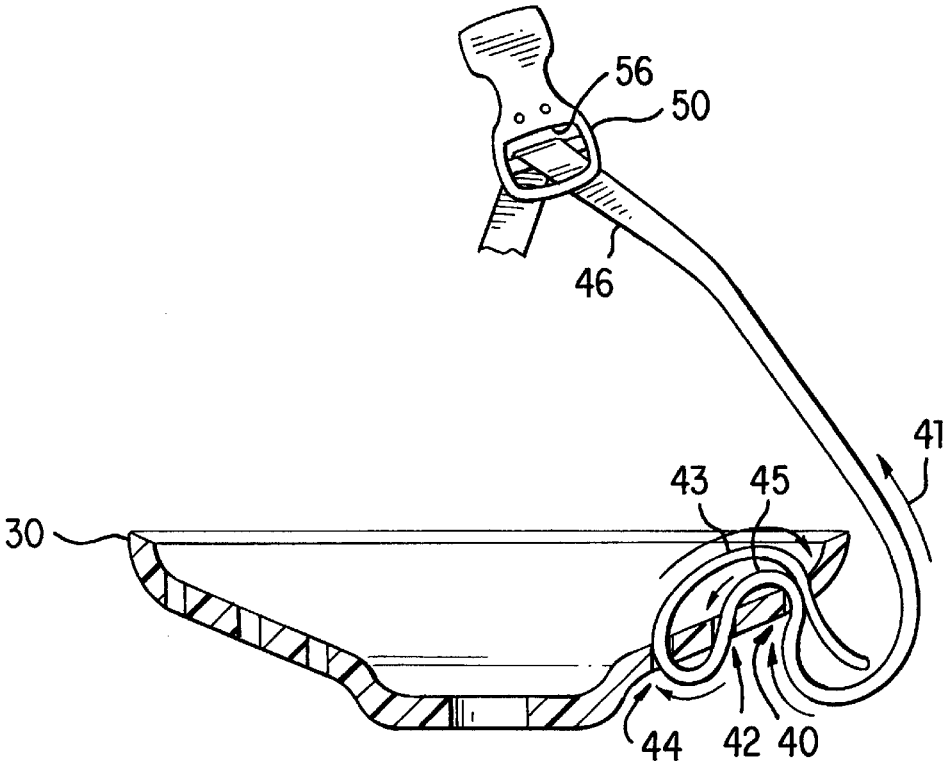
FIG. 9 is a partial, vertical cross-sectional detail view of the cup of the present invention with one of the straps shown interwoven therein.

The cup 30 also has a plurality of holes 40, 42 and 44, with which straps 46, as shown in FIGS. 1, 2 and 9, are attached. Although the specific radial orientation of the slots in each grouping A with respect to each other is not essential to the functioning of the device, the circumferential orientation of each grouping has been found to provide the best orientation of the straps 46 with respect to the ball 12 in order to keep the ball 12 secure to the device.

Referring particularly to FIG. 9, the straps 46 are interwoven among the holes 40, 42 and 44, so that they bind themselves against slipping with respect to the cup 30. The tighter the straps are pulled in the direction indicated by the numeral 41, the more the overlapping portions 43 constrain the overlapped portions 45 resisting slippage of the straps.

Figure 5:
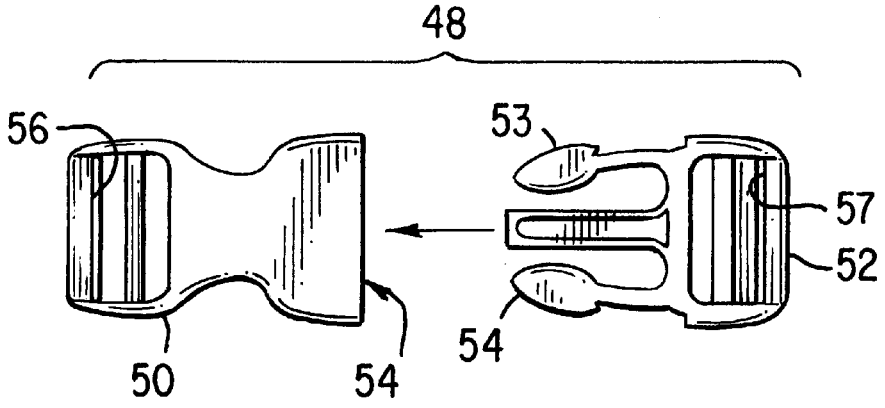
FIG. 5 is a detailed view of the fastener of the present invention shown in the unfastened position.
Figure 6:
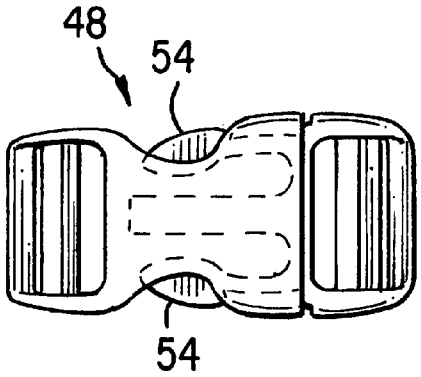
FIG. 6 is a plan view of the fastener shown in the fastened position.

Referring to FIGS. 5 and 6, the device includes a quick-release fastener 48. The fastener 48 includes a female part 50 and a male part 52. The female part 50 has a transverse slot 55 which receives the transverse tongue 53 of the male part 52. The male part 52 has flanges 54 that are received in side apertures of the female part 50. To release the male and female parts, the user squeezes together the flanges 54, thus unlocking the male part from the female part and allowing the tongue 53 to be removed from the slot 55. The female part 50 also has an aperture 56 for receiving a strap. The male part also has an aperture 57 for receiving a strap.

Figure 7:
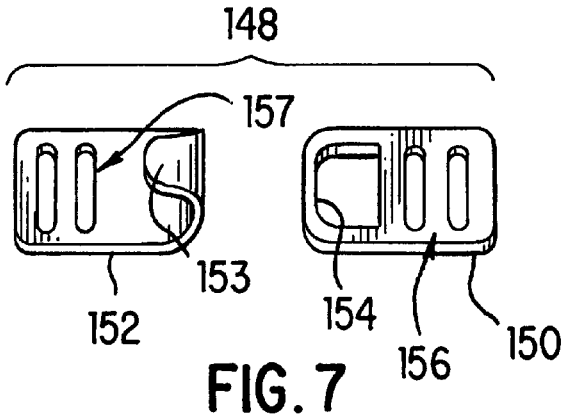
FIG. 7 is a plan view of an alternative fastener of the present invention shown in the unfastened position.

Referring to FIG. 7, an alternative fastener 148 is shown. The fastener 148 includes a female part 150 and a male part 152. The female part 150 has a vertical throughbore 154 which receives the rearwardly-turned tongue 153 of the male part 152. To release the female part 150 and the male part 152, the user urges the male part 152 toward the female part 150 so as to gain clearance of the tongue 153 so that it may be withdrawn from the throughbore 154 of the female part 150. The female part 150 also has at least one aperture 156 for receiving a strap. The male part 152 also has at least one aperture 157 for receiving a strap.

Figure 8:
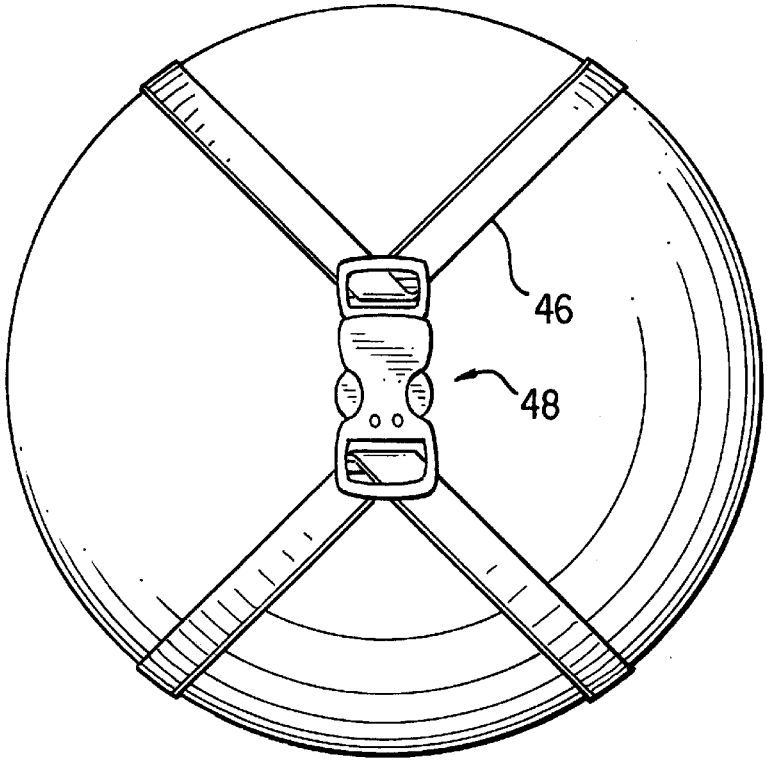
FIG. 8 is plan view of the invention having captured a ball.

Referring to FIG. 8, the advantage of the quick-release fastener 48 or 148 is that it not only maintains the orientation of the straps 46 relative to the various quadrants of the ball, thus insuring confinement of the ball to the device, but allows the user to quickly employ a ball of choice in the device or in a conventional game. Because the fastener is so easy to secure and release, the user will not be discouraged from using the device in consideration of tight timing constraints.

The convention of using the straps 46 in conjunction with the cup 30 frees the device from the permanently stitched strap conventions of prior art devices. The holes 40, 42, 44 permit ready adjustment of the sizing of the straps 46 so as to permit use of the device with balls of different sizes and configurations.

Referring to FIGS. 1, 4, 5, 8 and 9, in use, one strap 46 is routed from a first group of holes A of the cup 30, in the fashion shown in FIG. 8. Then the strap 46 is routed through the aperture 56 of the female member 50 and then secured to the cup 30 through a second set of holes B. A second strap 46 is configured similarly only with the other two holes and the aperture 57 of the male member 52. This fastening convention provides for ready, secure affixation of a soccer ball to the device, a strap confining each quarter of the ball. The fastening convention also permits the user to quickly release the ball for actual play.

Figure 10:
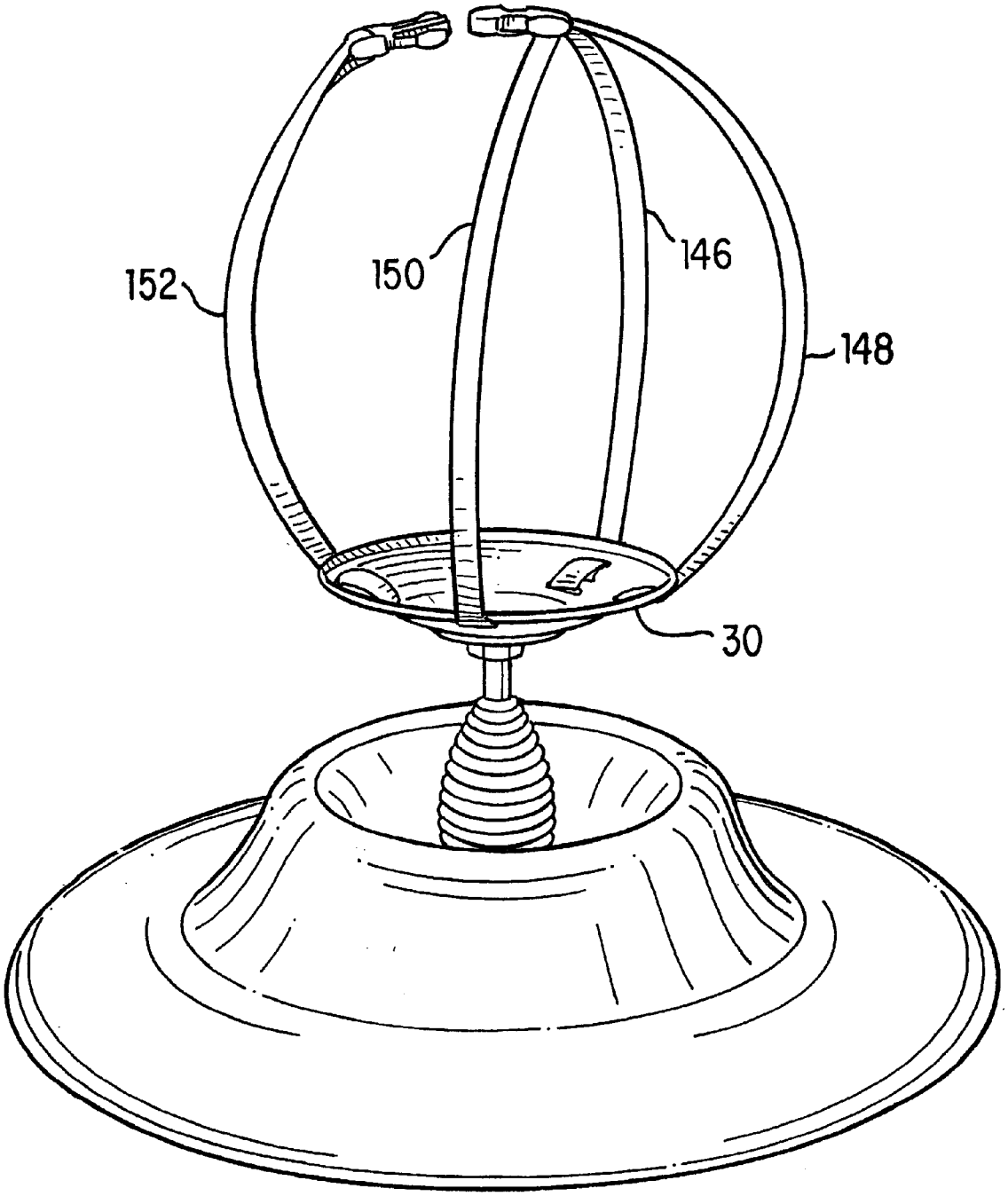
FIG. 10 is a top front perspective view of another embodiment of the invention.

Referring to FIG. 10, another embodiment of the straps is shown. In this embodiment, a first strap 146, and a second strap 148 extend from the cup 30 and are co-joined to one of either male or female parts of the fastener described above. The straps are fixed so as to embrace three quadrants of a ball. Once a ball is received by the straps, the third strap 152, having the other of the male or female part of the fastener, is wrapped along with the fourth quadrant of the ball, the fastener parts being engaged and locked.

Figure 10A:
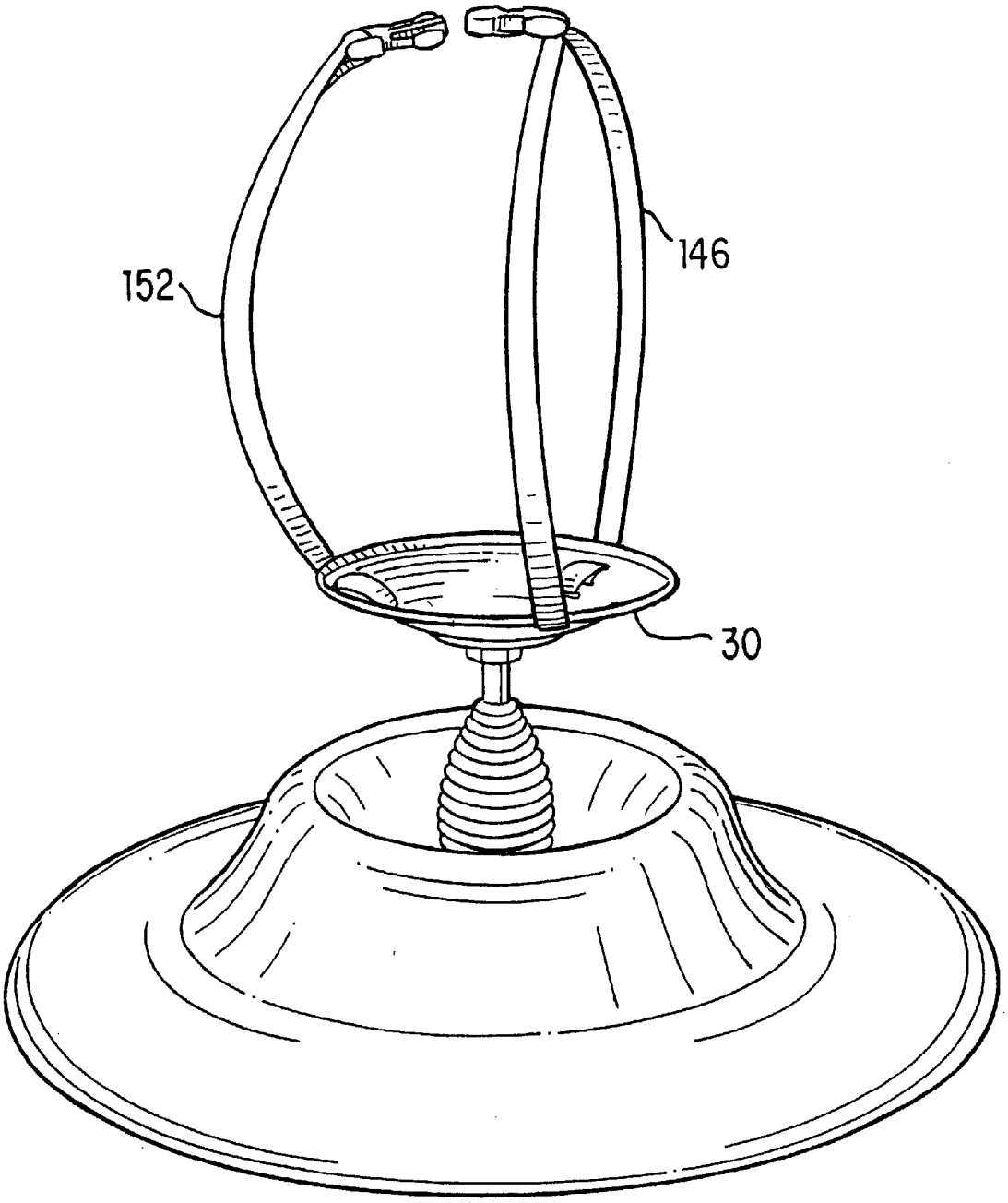
FIG. 10A is a modification of the embodiment of FIG. 10.

FIG. 10A discloses a modification of the embodiment of FIG. 10. In this modification, there is no third strap. The three attachment points are equally spaced about the base 10. When the ball is held onto the base by the straps, the straps are equally spaced about the ball.

Figure 12:
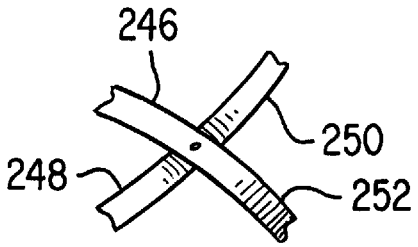
FIG. 12 is a plan view of the embodiment shown in FIG. 11.
Figure 11:
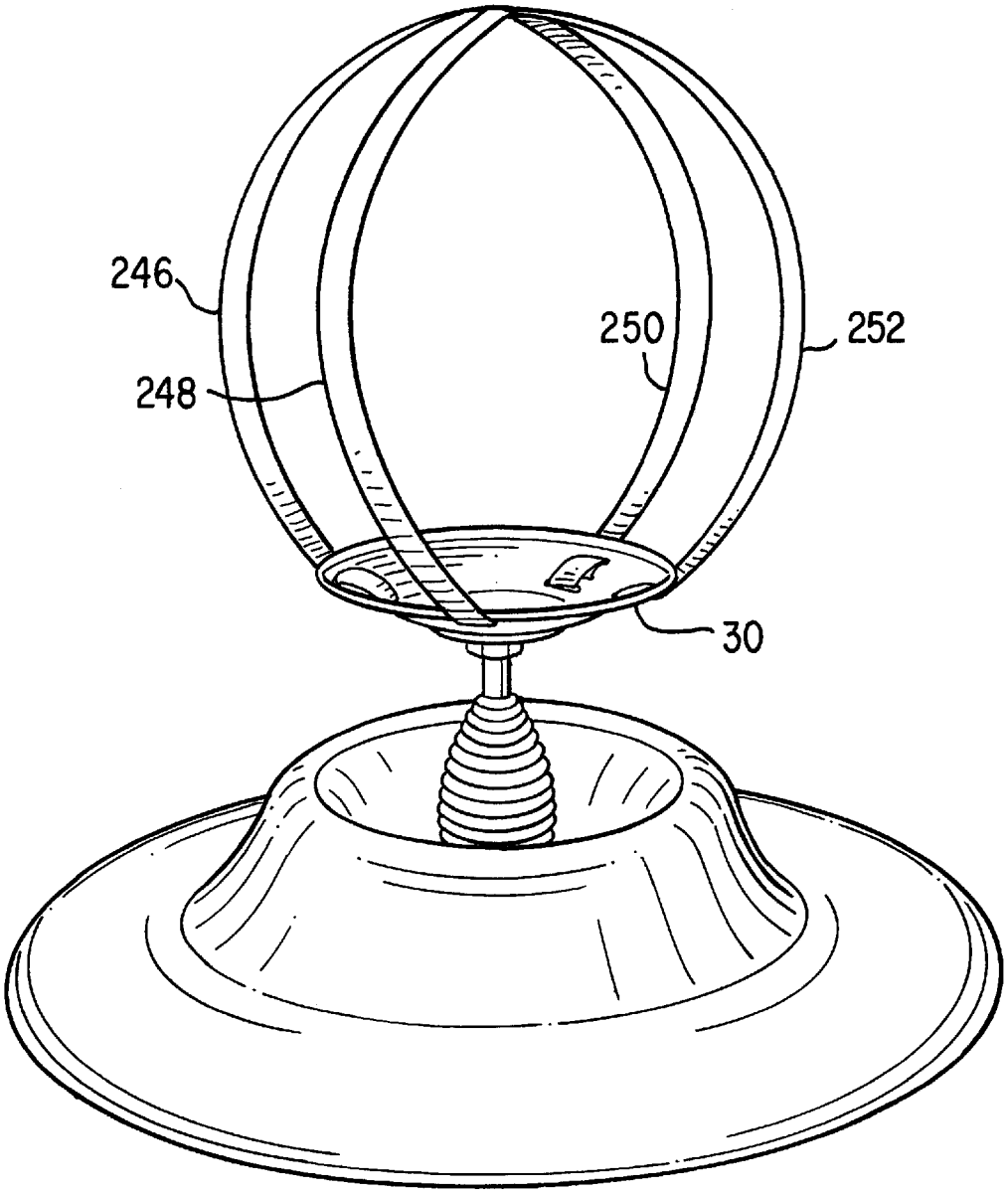
FIG. 11 is a top front perspective view of yet another embodiment of the invention.

Referring to FIGS. 11 and 12, another embodiment of the straps is shown. In this embodiment, a first strap 246, a second strap 248, a third strap 250 and a fourth strap 252 extend from the cup 30 and are co-joined with a fastener, such as a grommet or hook-and-loop fasteners.

This invention has been described with reference to preferred embodiments. These embodiments are not intended to be limiting as several modifications would be apparent to one of ordinary skill in the art. These modifications do not depart from the spirit and scope of the invention.

I claim:

1. A sports training device, comprising, a base having a ball supporting surface, a plurality of means for releasably securing a strap, each means formed at a separate attachment point in said ball supporting surface, a strap attached to each means for releasably securing a strap for retaining a ball to the ball supporting surface.

2. The sports training device of claim 1, wherein the plurality of means for releasably securing a strap is four.

3. The sports training device of claim 1, wherein the means for releasably securing a strap are equally spaced about the ball supporting surface.

4. The sports training device of claim 1, wherein the means for releasably securing a strap comprise three apertures in the ball supporting surface.

5. The sports training device of claim 4, wherein the three apertures are radially aligned.

6. The sports training device of claim 1, wherein the ball supporting surface is a conical surface having an upstanding rim for engaging the ball.

7. The sports training device according to claim 1, wherein the base has a ground engaging portion and a stem extending upwardly from the ground engaging portion, the stem attached to the ball supporting surface.

8. A sports training device, comprising a base having a ball supporting surface, a first strap and a second strap attached to the ball supporting surface, at a plurality of attachment points each strap having a first end and a second end, each end of each strap attached to the ball supporting surface, a first fastener on the first strap, a second fastener on the second strap, the second fastener mating with the first fastener.

9. The sports training device of claim 8, further comprising a first, second, third and fourth attachment point on the ball supporting surface, the first attachment point opposite the third attachment point and adjacent the second and fourth attachment points, the first strap having its first end attached to the first attachment point and its second and attached to the second attachment point, and the second strap, having its first end attached to the third attachment point and its second end attached to the fourth attachment point.

10. The sports training device of claim 6, wherein the attachment points are evenly spaced about the ball supporting surface.

11. The sports training device of claim 8, wherein the straps are releasably attached to the ball supporting surface.

12. The sports training device according to claim 8, wherein the base has a ground engaging portion and a stem extending upwardly from the ground engaging portion, the stem attached to the ball supporting surface.

13. The sports training device according to claim 8, wherein a first strap is connected to a first attachment point, a second strap is connected to a second attachment point, a first connector at a junction of the first and second strap, a third strap attached to a third attachment point, the third strap having the connector mating with a connector at the junction of the first and second strap.

14. The sports training device according to claim 13, wherein the first and second strap are a single strap.

15. The sports training device according to claim 13, further comprising a fourth strap attached to a fourth attachment point, the fourth strap attached at the junction of the first and second strap.

16. A sports training device, comprising a base having a ball supporting surface, a first strap having a first end and second end, the first end attached to the ball supporting surface at a first attachment point and a second end attached to the ball supporting surface at a second attachment point, a first fastener attached to the first strap, a second strap having a first end and a second end, the second strap first end attached to the ball supporting surface at a third attachment point, and a second fastener attached to the second strap, the second fastener complementary to the first fastener.

17. The sports training device of claim 16, wherein the first, second and third attachment points are equally spaced from one another about the base.

18. The sports training device of claim 16, wherein the first attachment point is opposite the second attachment point.

19. The sports training device of claim 16, further comprising a third strap having a first and second end, the third strap first end attached to the ball supporting surface at a fourth attachment point, the third strap second end attached to the first strap.

* * * * *